US012215619B2

(12) United States Patent
Shepherd et al.

(10) Patent No.: US 12,215,619 B2
(45) Date of Patent: Feb. 4, 2025

(54) HYBRID PUMP APPARATUS

(71) Applicant: CONCENTRIC BIRMINGHAM LIMITED, Birmingham (GB)

(72) Inventors: Paul Shepherd, Hampton in Arden (GB); Sreekanth Gopinathan Nair, Glenfield (GB)

(73) Assignee: CONCENTRIC BIRMINGHAM LIMITED, Birmingham (GB)

( * ) Notice: Subject to any disclaimer, the term of this patent is extended or adjusted under 35 U.S.C. 154(b) by 526 days.

(21) Appl. No.: 17/568,536

(22) Filed: Jan. 4, 2022

(65) Prior Publication Data

US 2022/0213833 A1 Jul. 7, 2022

(30) Foreign Application Priority Data

Jan. 5, 2021 (GB) ..... 2100078

(51) Int. Cl.
*F01P 5/12* (2006.01)
*F04D 13/02* (2006.01)
*F04D 13/06* (2006.01)

(52) U.S. Cl.
CPC ..... *F01P 5/12* (2013.01); *F04D 13/021* (2013.01); *F04D 13/06* (2013.01); *F01P 2005/125* (2013.01)

(58) Field of Classification Search
CPC ..... F01P 5/12; F01P 2005/125; F01P 7/162; F01P 7/164; F01P 11/00; F04D 13/021; F04D 13/06; F04D 13/0666; F04D 29/044; F04D 25/02
See application file for complete search history.

(56) References Cited

U.S. PATENT DOCUMENTS 4,955,260 A * 9/1990 Oshidari ..... F16H 61/66272 477/45
6,413,183 B1 7/2002 Ishikawa et al.
6,425,838 B1 7/2002 Matsubara et al.
6,770,005 B2 8/2004 Aikawa et al.
7,162,870 B1 1/2007 Hauser
7,347,047 B1 3/2008 Hauser
8,876,644 B2 11/2014 Riegert et al.
9,028,228 B2 * 5/2015 Shepherd ..... F04D 15/0027 417/420
9,765,827 B2 * 9/2017 Qin ..... F04D 13/06
2002/0000353 A1 1/2002 Katou et al.
(Continued)

FOREIGN PATENT DOCUMENTS

CN 204041128 12/2014
CN 204610324 9/2015
(Continued)

*Primary Examiner* — Dominick L Plakkoottam
(74) *Attorney, Agent, or Firm* — HODGSON RUSS LLP

(57) ABSTRACT

A hybrid pump apparatus (100) having a pump subassembly having an inlet and an outlet an electrical drive (110) arranged to selectively drive the pump subassembly, a mechanical drive comprising a driven member (104) configured to receive a drive torque; and a clutch (160) in a load path between the driven member and the pump subassembly, the clutch being movable between a first condition in which the driven member drives the pump subassembly and a second condition in which the driven member can rotate freely relative to the pump sub assembly in which the clutch is a dog clutch.

18 Claims, 3 Drawing Sheets

(56) References Cited

U.S. PATENT DOCUMENTS

| | | | | |
|---|---|---|---|---|
| 2003/0127262 | A1 | 7/2003 | Noreikat et al. | |
| 2003/0230461 | A1 | 12/2003 | Sakata et al. | |
| 2005/0026733 | A1 | 2/2005 | Yoshioka et al. | |
| 2005/0072397 | A1 | 4/2005 | Sluka et al. | |
| 2005/0187066 | A1 | 8/2005 | Moses et al. | |
| 2005/0207915 | A1 | 9/2005 | Fledersbacher et al. | |
| 2005/0211490 | A1 | 9/2005 | Shimizu et al. | |
| 2006/0054445 | A1 | 3/2006 | Pashnik et al. | |
| 2008/0032842 | A1 | 2/2008 | Johnson et al. | |
| 2008/0173512 | A1 | 7/2008 | Kaneko et al. | |
| 2008/0194369 | A1* | 8/2008 | Boutou | B60L 50/61 475/5 |
| 2009/0314600 | A1 | 12/2009 | Kato et al. | |
| 2010/0231062 | A1* | 9/2010 | Sykes | H02K 3/47 310/46 |
| 2012/0077632 | A1* | 3/2012 | Babbitt | B60K 6/12 475/1 |
| 2012/0190493 | A1 | 7/2012 | Tamoto | |
| 2013/0112523 | A1 | 5/2013 | Ikegawa | |
| 2013/0149110 | A1 | 6/2013 | Pummell et al. | |
| 2013/0151131 | A1 | 6/2013 | Laszlo et al. | |
| 2013/0231836 | A1 | 9/2013 | Moseler | |
| 2013/0341151 | A1 | 12/2013 | Ikegawa | |
| 2014/0286801 | A1 | 9/2014 | Böhm | |
| 2015/0044074 | A1* | 2/2015 | Baeuerle | F04D 13/022 417/319 |
| 2015/0094893 | A1 | 4/2015 | Hopkirk et al. | |
| 2015/0184575 | A1 | 7/2015 | Shutty et al. | |
| 2016/0252000 | A1* | 9/2016 | VanZuilen | F04D 15/0066 123/41.02 |
| 2017/0167326 | A1 | 6/2017 | Horimatsu et al. | |
| 2017/0276038 | A1 | 9/2017 | Mukohara | |
| 2018/0162374 | A1* | 6/2018 | Colavincenzo | B60K 6/448 |
| 2018/0179923 | A1* | 6/2018 | Shepherd | F01M 1/02 |
| 2018/0216637 | A1* | 8/2018 | Kamoshita | F15B 13/06 |
| 2018/0363761 | A1* | 12/2018 | Parisi | F16H 61/0028 |
| 2019/0001805 | A1* | 1/2019 | Colavincenzo | B60W 20/15 |
| 2019/0024668 | A1* | 1/2019 | Golm, Jr. | F04D 25/0606 |
| 2019/0153914 | A1* | 5/2019 | Parisi | F16H 61/0028 |
| 2022/0094229 | A1* | 3/2022 | Lines | H02K 1/182 |

FOREIGN PATENT DOCUMENTS

| | | | | |
|---|---|---|---|---|
| CN | 106931121 | A * | 7/2017 | |
| CN | 207960984 | | 10/2018 | |
| DE | 10214637 | | 10/2003 | |
| DE | 102005039868 | | 3/2006 | |
| DE | 102005060180 | A1 * | 6/2006 | H02K 1/14 |
| DE | 102007017487 | | 1/2008 | |
| DE | 102011016558 | A1 | 10/2012 | |
| DE | 102011088060 | | 6/2013 | |
| DE | 102012002759 | | 8/2013 | |
| DE | 102014223327 | | 6/2015 | |
| DE | 102014220377 | | 4/2016 | |
| DE | 102017121745 | | 3/2018 | |
| DE | 102017102769 | | 6/2018 | |
| DE | 102017118264 | | 2/2019 | |
| DE | 102017118264 | A1 * | 2/2019 | F01P 5/12 |
| DE | 212018000135 | | 9/2019 | |
| DE | 102018107776 | | 10/2019 | |
| DE | 102018211799 | | 1/2020 | |
| EP | 1128080 | A1 * | 8/2001 | F16D 11/14 |
| EP | 1108572 | | 10/2005 | |
| EP | 2853711 | | 4/2015 | |
| EP | 2613954 | | 7/2017 | |
| EP | 2440762 | | 3/2019 | |
| FR | 3029464 | A1 | 6/2016 | |
| GB | 2273323 | A | 6/1994 | |
| KR | 101617552 | B1 | 5/2016 | |
| WO | 02093042 | A2 | 11/2002 | |
| WO | 2002093042 | | 11/2002 | |
| WO | 2010142041 | | 12/2010 | |
| WO | 2013007247 | A1 | 1/2013 | |
| WO | 2016134426 | | 9/2016 | |
| WO | 2016146286 | A1 | 9/2016 | |
| WO | 2018044323 | | 3/2018 | |
| WO | 2018142251 | | 8/2018 | |
| WO | 2018229670 | | 12/2018 | |

* cited by examiner

HYBRID PUMP APPARATUS

CROSS-REFERENCE TO RELATED APPLICATION

The present disclosure is based on and claims priority to GB Application No. 2100078.1, filed Jan. 5, 2021, the entire disclosure of which is incorporated by reference herein.

FIELD OF THE INVENTION

The present invention is concerned with a hybrid pump apparatus. More specifically, the present invention is concerned with a vehicle hybrid pump apparatus, for example a vehicle hybrid pump apparatus for a coolant fluid.

BACKGROUND

Internal combustion (IC) engines have many uses—for example they may be used to power on- and off-highway vehicles, or for power generation. Many IC engines have a fluid-based cooling system in order to keep the engine at the optimum temperature. Such cooling systems typically employ a liquid medium to transfer heat energy from parts of the engine that are prone to overheating to other parts of the engine or vehicle (e.g. a radiator for heat dissipation). This is particularly important for heavy commercial vehicles such as goods vehicles, and heavy goods vehicles (HGVs) in particular.

IC engines are provided with a cooling circuit containing the coolant. The circuit extends from a heat source (such as the engine block) to an appropriate heat sink (such as the vehicle radiator). Pumping fluid around the circuit ensures transmission and dissipation of heat energy. A coolant pump is provided, the pump comprising an impeller driven by a shaft. A pump pulley is mounted to the shaft. The engine crankshaft also has a pulley mounted thereto, and a belt drive drivingly engages the crankshaft and pump pulleys such that the impeller is driven by the crankshaft.

Although a gear ratio may be provided by appropriately sizing the pulleys, in such systems the speed of the input shaft (and hence the impeller) is proportional to the speed of the engine. As such the size of the pulleys must be selected to provide sufficient cooling for the most demanding situation.

In certain circumstances it is desirable to reduce the effect of the cooling circuit. For example, upon startup it is desirable for the IC engine to heat up to its optimum operating temperature quickly. Therefore, conduction and convection of thermal energy away from the engine block is not desirable. Once the engine is up to temperature, and perhaps undergoing a heavy duty cycle, it is important that the coolant system can work at maximum effectiveness to avoid overheating. It is always desirable to reduce unnecessary coolant flow because this creates a parasitic power loss. Reduction in unnecessary flow of coolant can therefore provide a fuel saving.

In order to address this need, hybrid pumps including an electric motor as well as a mechanical drive have been developed. By connecting or disconnecting the electric motor or the mechanical drive, the output of the pump can be adjusted. Such hybrid pumps tend to be complex, including arrangements of gears and solenoid assemblies.

What is required is a less complex solution that is compact to fit into the typically crowded environments in which IC engines are found.

What is also required is a system which allows for a failsafe condition which will ensure pumping operation during an electrical failure event so as to prevent the engine from becoming too hot.

SUMMARY OF THE INVENTION

According to an aspect of the present invention, there is a hybrid pump apparatus comprising:

- a pump subassembly having an inlet and an outlet;
- an electrical drive arranged to selectively drive the pump subassembly;
- a mechanical drive comprising a driven member configured to receive a drive torque; and
- a clutch in a load path between the driven member and the pump subassembly, the clutch being movable between a first condition in which the driven member drives the pump subassembly and a second condition in which the driven member can rotate freely relative to the pump sub assembly;
- in which the clutch is a dog clutch.

Advantageously, the use of a dog clutch removes the need to include a complex gear arrangement within the pump apparatus. The hybrid pump apparatus also has a compact and light arrangement.

The dog clutch may be configured to move to the first condition upon interruption of electrical power to the electrical drive.

The dog clutch may comprise a first dog clutch component which is configured for operable connection to the driven member and a second dog clutch component. The second dog clutch component may be resiliently biased by a spring. Additionally or alternatively, the second dog clutch component may be at least partially constructed from a ferromagnetic material.

The electrical drive may include a rotor and a stator. The stator may be an axial stator and/or the stator may be yokeless.

An electromagnetic field produced by the stator may cause the clutch to move to the second condition.

Preferably

- the dog clutch defines a clutch axis;
- the dog clutch comprises a plurality of cooperating teeth for transferring torque;
- the plurality of teeth each define a mating surface provided at a tooth angle; and,
- the tooth angle is at a non-zero angle to the clutch axis.

The tooth angle is preferably between 5 and 20 degrees. The tooth angle is preferably selected to reduce the axial force required to disengage the dog clutch to a separation force above zero. In this way, less energy is required by the disengagement mechanism (e.g. solenoid) than if the tooth angle was 0 (i.e. parallel to the clutch axis).

The hybrid pump apparatus may be a vehicle hybrid pump apparatus, for example an internal combustion engine hybrid pump apparatus. The hybrid pump apparatus may be a vehicle hybrid pump apparatus for a coolant fluid.

Preferably the electrical drive is configured to generate electricity when driven by the mechanical drive in a 'regen' mode.

Whilst the invention has been described above, it extends to any inventive combination of the features set out above or in the following description or drawings.

BRIEF DESCRIPTION OF THE DRAWINGS

An example hybrid pump apparatus will now be described with reference to the accompanying drawings in which.

DETAILED DESCRIPTION OF AN EMBODIMENT

Figure 1:
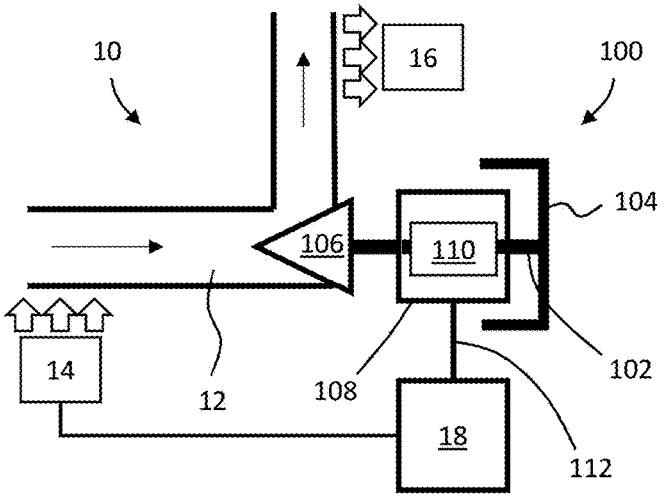
FIG. 1 is a schematic representation of part of a coolant circuit and a hybrid pump apparatus in accordance with the present invention.

Referring to FIG. 1, an IC engine coolant circuit 10 is arranged to convey a liquid coolant 12 from a heat source in the form of engine component 14 to a radiator 16. The liquid coolant 12 is recirculated in the circuit 10. The engine 14 is controlled by an electronic engine control unit (ECU) 18, as known in the art.

A hybrid pump apparatus 100 comprises a shaft 102 which is connected to a mechanical drive having a driven member in the form of a pulley 104 at one end and an impeller 106 at a second, opposite, end. The shaft 102 extends through a pump housing 108 in which an electrical drive in the form of electric motor 110 is provided. The impeller 106 is arranged to pump the coolant 12 around the circuit 10.

The ECU 18 is configured to provide command signals to the gearbox via data line 112.

Figure 2:
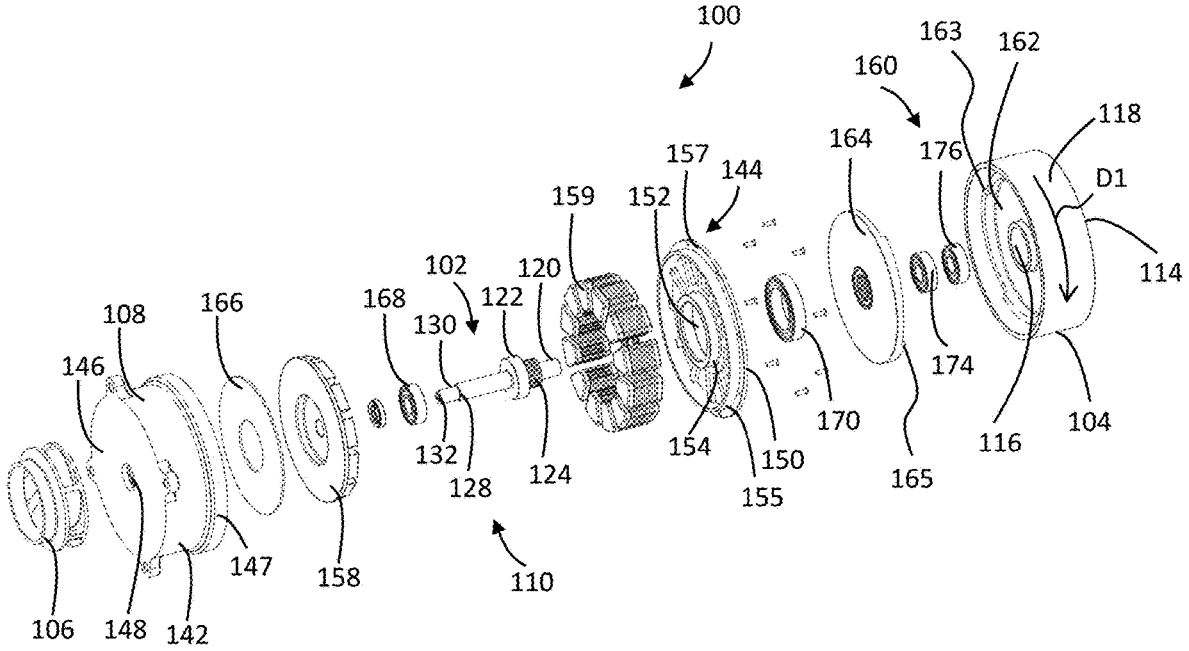
FIG. 2 is an exploded diagram showing a hybrid pump apparatus according to the present invention.
Figure 3:
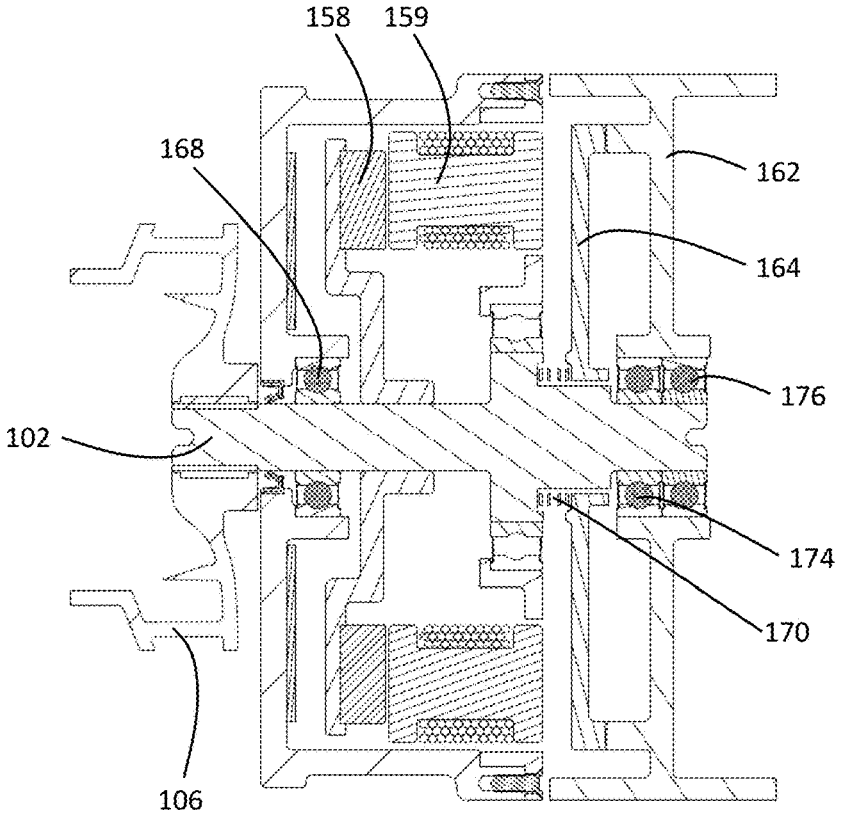
FIG. 3 is a section view of the hybrid pump apparatus of FIG. 2 in a first configuration.
Figure 4:
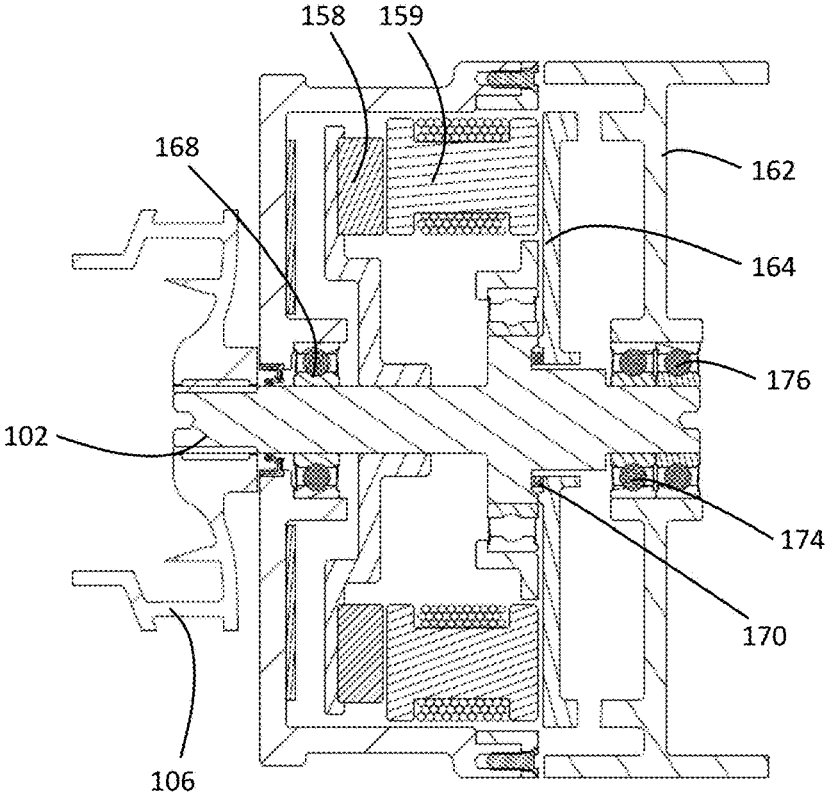
FIG. 4 is a section view of the hybrid pump apparatus of FIG. 2 in a second configuration.

The hybrid pump apparatus 100 is shown in FIGS. 2, 3 and 4.

Referring to FIG. 2, the hybrid pump apparatus 100 is shown in more detail.

The shaft 102 is a solid cylindrical component having a first end 120. Proximate the first end 120, there is provided an annular collar 122 having a shoulder 124 facing the first end 120. At a second end 126 of the shaft 102 there is provided a shoulder 128 leading to a smaller diameter section 130 which comprises a central bore 132.

The pulley 104 is an open, cylindrical body with one closed end wall 114 having a central shaft engagement formation 116. The pulley 104 defines a cylindrical outer surface 118 which is contacted and driven by a belt (not shown) in use.

The impeller 106 is positioned at a second end 126 of the shaft 102.

The hybrid pump apparatus 100 comprises a pump sub-assembly in the form of a housing 108 having a first housing part 142 and a second housing part 144. The first housing part 142 is hollow and generally cylindrical, having an end wall 146 at one end and a collar 147 at an opposite end. The end wall 146 defines a central bore 148. The second housing part 144 defines an annular wall 150 having a central bore 152. A first cylindrical portion 154 extends from the central bore 152. A second cylindrical portion 155 extends from an inner surface of the second housing part 144 such that a lip 157 is formed between the annular wall 150 and the first cylindrical portion 154. The outer diameter of the second cylindrical portion 155 fits within the first housing part 142. The outer diameter of the annular wall 150 is sized for a press fit with the inner diameter of the first housing part 142. In this way, the housing parts can be assembled to form a closed chamber containing the electric motor 110.

The electric motor 110 includes a rotor 158 and a stator 159. In embodiments of the invention, the stator 159 is a yokeless, axial stator.

The hybrid pump apparatus 100 also includes a clutch 160 in the form of a dog clutch having a first dog clutch component 162 which is operably connected to the pulley 104 and a second dog clutch component or plate 164 which is at least partially constructed from a ferromagnetic material. The dog clutch 160 relies on a mechanical interlocking between the two components (rather than e.g. friction) such that the clutch cannot slip when engaged. Each of the components 162, 164 defines a respective axial, annular face 167, 169 having a plurality of interlocking teeth 163, 165 respectively. The teeth each define faces that are flat and planar, and face in a generally circumferential direction. The teeth 163 of the clutch component 162 face in a direction D1 (the drive direction) whereas the teeth 165 of the clutch component 164 face in the opposite direction such that rotation of the clutch component 162 indirection D1 drives rotation of the clutch component 164. Rather than being parallel to the axis of rotation of the clutch (when viewed from a radial direction), the teeth are at a non-zero angle TA. The angle TA is such that the surface of each tooth 163 on each clutch component forms an opening angle OA above 90 degrees (i.e. OA=TA+90) with the adjacent part of the face 167, 169. Specifically, in this embodiment the angle TA is 8 degrees (although values less than 10 degrees are selected based on e.g. the coefficient of friction between the materials as will be described below). This reduces the amount of axial force required to disengage the teeth.

The hybrid pump apparatus is assembled as follows.

An electronic control board 166, a pump housing bearing 168, and the rotor 158 and stator 159 of the motor 110 are mounted within the hollow first housing part 142 of the pump housing 108.

The shaft 102 is mounted through the central apertures in each of the components such that the annular collar 122 of the shaft 102 abuts the stator 159 and the smaller diameter section 130 of the shaft 102 extends through the central bore 148 of the first housing part 142.

The impeller 106 is then mounted on the smaller diameter section 130 of the shaft 102.

A resilient biasing element in the form of a spring 170 is placed on the shoulder 124 of the shaft 102. The second housing part or cover 144 is then bolted to the first housing part 142 to secure the motor 110 within the pump housing 108.

The second dog clutch component 164 is mounted on the shoulder 124 of the shaft 102 and the dog clutch bearings 174, 176 are positioned at the first end 120 of the shaft 102.

The first dog clutch component 162 is positioned within the open cylindrical body of the pulley 104, which is then mounted on the second housing part or cover 144.

The spring 170 is configured such that the second dog clutch component 164 is resiliently biased in an axial direction towards the first dog clutch component 162. The second dog clutch component 164 is able to slide along the shoulder 124 of the shaft 102.

The hybrid pump assembly is operated as follows.

With the motor 110 switched off, the second dog clutch component 164 is resiliently biased towards the first dog clutch component 162. If the IC engine of the vehicle is running, the pulley 104 will be running. In this first, 'high flow' condition, the shaft 102 is driven by the pulley 104 and the impeller 106 is caused to rotate.

An air gap, supported by the spring 170, will be formed between the second dog clutch component 164 and the pump housing 108. The components of the motor 110 and the impeller 106 will rotate by virtue of their connection to the shaft 102.

The first mode is for a high cooling demand at high engine speed. The pump is driven by the engine at higher speeds not achievable by electric drive. This is also the default mode for the failsafe mechanism (i.e. electrical failure).

In a second condition ('reduced flow') when the motor 110 is switched on, an electromagnetic field will be produced by the stator 159. The electromagnetic field will attract the second dog clutch component 164 (which includes a ferromagnetic material). The magnetic attraction between the stator 159 and the second dog clutch component 164 is sufficient to overcome the resilience of the spring 170 and thus the second dog clutch component 164 will be moved away from the first dog clutch component 162 towards the stator 159.

is for high cooling demand due to heat soak after the engine is shut down. The pump can be driven to circulate coolant even when the engine is off. This helps to avoid damage to engine.

In a fifth mode, 'regen', the motor is driven by the pulley with the clutch engaged, and used as a generator to provide an electrical output to the vehicle. The electric motor works as a generator to harvest wasted mechanical energy and feed it back into vehicle battery for storage. This aids fuel economy and CO2 emissions.

In the instance that the motor 110 is switched off, or there is a failure resulting in the interruption of electrical power to the electrical drive, the electromagnetic field is lost, and the spring 170 bias the second dog clutch component 164 towards the first dog clutch component 162 (i.e. into a 'failsafe' mode).

The following table provides a summary of the running modes of the hybrid pump apparatus 100.

| Mode | Description | Pulley state | Clutch State | Motor rotor state | Impeller state | Impeller speed ratio |
|---|---|---|---|---|---|---|
| 1 | High flow | Running | Engaged | Driven | Running | 1 |
| 2 | Reduced flow | Running | Disengaged | Driver | Running | <1 |
| 3 | Over flow | Running | Disengaged | Driver | Running | >1 |
| 4 | Engine off | Not running | Disengaged | Driver | Running | ∞ |
| 5 | Regen | Running | Engaged | Driven | Running | 1 |
| 6 | Failsafe | Running | Engaged | Driven | Running | 1 |

Figure 5:
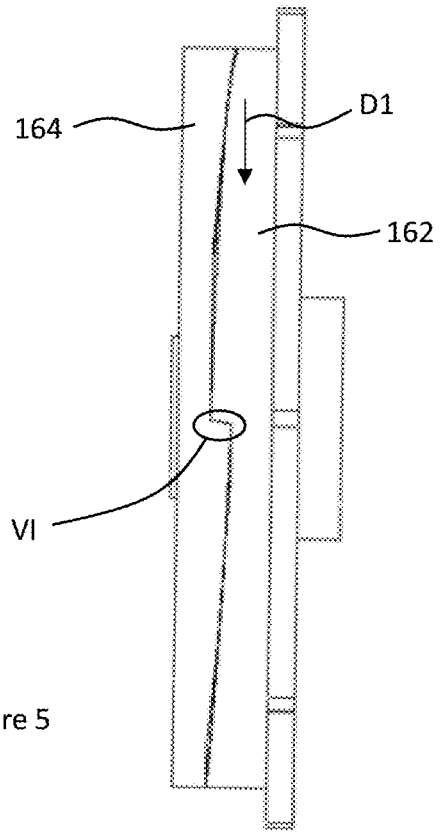
FIG. 5 is a side view of a part of the apparatus of FIG. 2.
Figure 6:
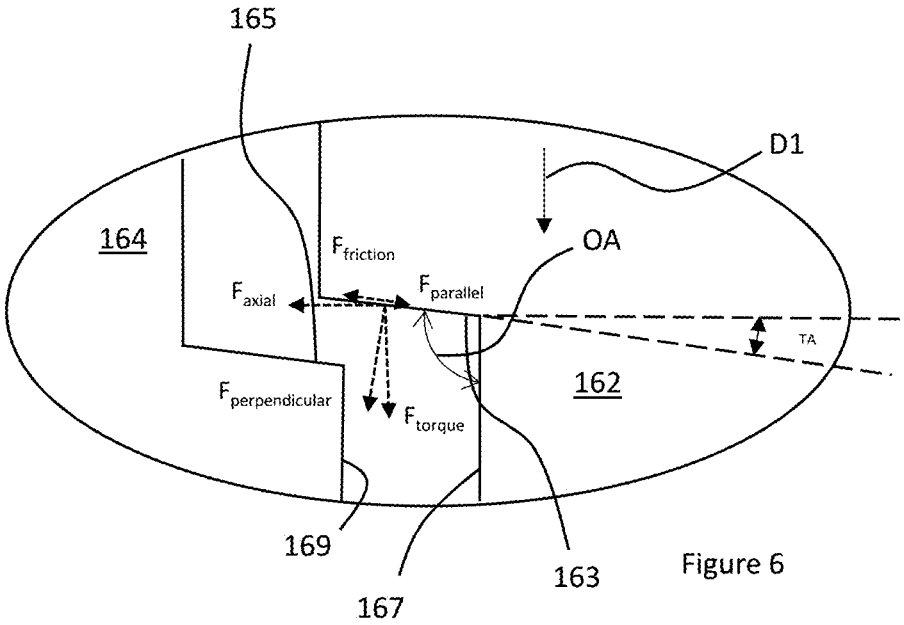
FIG. 6 is a detail view of region VI in FIG. 5.

The angle of the engaged teeth on the dog facilitate disengagement of the clutch. Referring to FIGS. 5 and 6, forces are shown as if the teeth were engaged. The force $F_{torque}$ driving the clutch members in rotation in direction D1 comprises a component normal to the surface 163 ($F_{perpendicular}$) and a component parallel to the surface ($F_{parallel}$). The perpendicular component results in a frictional force between the two surfaces $F_{friction}=\mu s \cdot F_{perpendicular}$. The parallel component $F_{parallel}$ acts to separate the two clutch components against $F_{friction}$. It will be noted that as TA grows, $F_{parallel}$ increases (because $F_{parallel}=F_{torque} \cdot \sin(TA)$), and at a certain value of TA (depending on the coefficient of static friction between the materials $\mu_s$), $F_{parallel}$ will increase beyond $F_{friction}$ and the plates will separate.

In the present invention, TA is selected that a separation force $SF=F_{friction}-F_{parallel}$, where SF>0 and TA>0. This means that an increase in TA can reduce the amount of separation force (SF) required of the solenoid compared to TA=0, thus reducing power consumption.

The spring 170 is compressed between the stator 159 and the second dog clutch component 164. With the electric motor 110 on, the shaft 102 is rotated by the electric motor 110 and thus the impeller 106 is rotated. In this, second, condition, the pulley 104 is able to rotate independently of the pump subassembly. The second mode is used for low cooling demand at high engine speed. The pump can be driven by the electric motor at a reduced speed by disengaging the clutch. This benefits fuel economy and CO2 emissions.

A third mode, 'over flow' is provided when the motor is run faster than the impeller can otherwise provide. It is for high cooling demand at low engine speed. The pump can be driven by electric motor at a higher speed than that which can be achieved by the engine. This benefits engine cooling and durability.

In a fourth mode, 'engine off', the pulley is not rotating at all, and all flow can be provided by the electric motor. This Although the invention has been described above with reference to preferred embodiments, it will be appreciated that various changes or modification may be made without departing from the scope of the invention as defined in the appended claims.

What is claimed is:

1. A vehicle hybrid pump apparatus comprising:

a pump subassembly;

an electrical drive arranged to selectively drive the pump subassembly;

a mechanical drive comprising a driven member configured to receive a drive torque; and a clutch in a load path between the driven member and the pump subassembly, the clutch being movable between a first condition in which the driven member drives the pump subassembly and a second condition in which the driven member can rotate freely relative to the pump subassembly;

in which the clutch is a dog clutch;

wherein the clutch is biased to move to the first condition upon interruption of electrical power to the electrical drive.

2. The vehicle hybrid pump apparatus according to claim 1, wherein the dog clutch comprises a first dog clutch component which is configured for operable connection to the driven member and a second dog clutch component.

3. The vehicle hybrid pump apparatus according to claim 2, wherein the second dog clutch component is resiliently biased by a spring.

4. The vehicle hybrid pump apparatus according to claim 2, wherein the second dog clutch component is at least partially constructed from a ferromagnetic material.

5. The vehicle hybrid pump apparatus according to claim 4, wherein the electrical drive includes a rotor and a stator.

6. The vehicle hybrid pump apparatus according to claim 5, wherein the stator is an axial stator.

7. The vehicle hybrid pump apparatus according to claim 6, wherein the stator is yokeless.

8. The vehicle hybrid pump apparatus according to claim 4, wherein the electrical drive includes a rotor and a stator and an electromagnetic field produced by the stator causes the clutch to move to the second condition.

9. The vehicle hybrid pump apparatus according to claim 1, wherein:

the dog clutch defines a clutch axis;

the dog clutch comprises a plurality of cooperating teeth for transferring torque;

the plurality of teeth each define a mating surface provided at a tooth angle; and the tooth angle is at a non-zero angle to the clutch axis.

10. The vehicle hybrid pump apparatus according to claim 9, wherein the tooth angle is between 5 and 20 degrees.

11. The vehicle hybrid pump apparatus according to claim 1, the vehicle hybrid pump apparatus being for a coolant fluid.

12. The vehicle hybrid pump apparatus according to claim 1, wherein the electrical drive is configured to generate electricity when driven by the mechanical drive.

13. A vehicle hybrid pump apparatus comprising:

a pump subassembly;

an electrical drive arranged to selectively drive the pump subassembly;

a mechanical drive comprising a driven member configured to receive a drive torque; and a clutch in a load path between the driven member and the pump subassembly, the clutch being axially movable between a first condition in which the driven member drives the pump subassembly and a second condition in which the driven member can rotate freely relative to the pump subassembly;

in which the clutch is a dog clutch and comprises a dog clutch component which is at least partially constructed from a ferromagnetic material;

wherein an electromagnetic field produced by a stator of the electrical drive causes the clutch to axially move to the second condition.

14. The vehicle hybrid pump apparatus according to claim 13, wherein the dog clutch further comprises a first dog clutch component which is configured for operable connection to the driven member, and wherein the dog clutch component which is at least partially constructed from the ferromagnetic material is a second dog clutch component.

15. The vehicle hybrid pump apparatus according to claim 13, wherein the clutch is configured to move to the first condition upon interruption of electrical power to the electrical drive.

16. The vehicle hybrid pump apparatus according to claim 14, wherein:

the dog clutch defines a clutch axis;

the dog clutch comprises a plurality of cooperating teeth for transferring torque;

the plurality of teeth each define a mating surface provided at a tooth angle; and the tooth angle is at a non-zero angle to the clutch axis.

17. The vehicle hybrid pump apparatus according to claim 16, wherein the tooth angle is between 5 and 20 degrees.

18. A vehicle hybrid pump apparatus comprising:

a pump subassembly;

an electrical drive, including a rotor and a yokeless axial stator, the electrical drive being arranged to selectively drive the pump subassembly;

a mechanical drive comprising a driven member configured to receive a drive torque; and a clutch in a load path between the driven member and the pump subassembly, the clutch being movable between a first condition in which the driven member drives the pump subassembly and a second condition in which the driven member can rotate freely relative to the pump subassembly;

in which the clutch is a dog clutch comprising a first dog clutch component which is configured for operable connection to the driven member and a second dog clutch component;

wherein the second dog clutch component is at least partially constructed from a ferromagnetic material and is resiliently biased by a spring to move the clutch to the first condition upon interruption of electrical power to the electrical drive; and wherein an electromagnetic field produced by the stator causes the clutch to move to the second condition.

* * * * *